US008763858B1

(12) United States Patent
Mouser, Jr.

(10) Patent No.: US 8,763,858 B1
(45) Date of Patent: Jul. 1, 2014

(54) TUBE EXTRACTION DEVICE

(71) Applicant: Gilbert Warren Mouser, Jr., Bemidji, MN (US)

(72) Inventor: Gilbert Warren Mouser, Jr., Bemidji, MN (US)

( * ) Notice: Subject to any disclaimer, the term of this patent is extended or adjusted under 35 U.S.C. 154(b) by 0 days.

(21) Appl. No.: 13/874,586

(22) Filed: May 1, 2013

(51) Int. Cl.
*B65D 35/28* (2006.01)

(52) U.S. Cl.
CPC ..... *B65D 35/28* (2013.01)
USPC ..... 222/103

(58) Field of Classification Search
CPC ..... B65D 35/28
USPC ..... 222/103, 97, 104, 105
See application file for complete search history.

(56) References Cited

U.S. PATENT DOCUMENTS

| | | | | |
|---|---|---|---|---|
| 2,678,755 | A * | 5/1954 | Buras, Jr. | 222/103 |
| 3,734,351 | A * | 5/1973 | Gaudin | 222/103 |
| 3,744,674 | A | 7/1973 | Funke | |
| 4,019,656 | A | 4/1977 | Spears | |
| 4,692,157 | A * | 9/1987 | Landau et al. | 604/214 |
| 4,722,457 | A * | 2/1988 | Bedwell et al. | 222/103 |
| 5,195,660 | A * | 3/1993 | Lekes | 222/103 |
| 5,322,194 | A | 6/1994 | Roberts | |
| 5,743,434 | A | 4/1998 | Light | |
| 5,975,363 | A | 11/1999 | Haycock | |
| 6,234,353 | B1 | 5/2001 | Light | |
| 6,318,596 | B1 * | 11/2001 | Wiesner | 222/1 |
| 2002/0170923 | A1 * | 11/2002 | Vatman | 222/102 |
| 2012/0248145 | A1 | 10/2012 | Kealy | |

FOREIGN PATENT DOCUMENTS

| | | | | |
|---|---|---|---|---|
| DE | 2655745 | A1 * | 6/1978 | B65D 35/28 |

* cited by examiner

*Primary Examiner* — Daniel R Shearer
(74) *Attorney, Agent, or Firm* — Jason L. Gilbert

(57) ABSTRACT

A tube extraction device for squeezing a substance out of a tube. The tube extraction device includes a base member and an upper plate hingedly secured to the base member. A lever including a handle portion and a cam portion is pivotally secured directly above the upper plate such that the cam portion rests thereon. An adjustment rod with an adjustably-secured constrictor is positioned below the base member. A knob at the end of the rod is used to advance the constrictor forward along the rod. As the constrictor advances, the upper plate constricts against the base member, thus dispensing the substance stored within any tube positioned between the upper plate and base member. If further pressure is needed, the lever may be pressed down to apply pressure from the cam portion directly onto the upper plate. A pressure knob may also be included for even more pressure capability.

16 Claims, 6 Drawing Sheets

TUBE EXTRACTION DEVICE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a tube dispenser and more specifically it relates to a tube extraction device for squeezing a substance out of a tube.

2. Description of the Related Art

Any discussion of the related art throughout the specification should in no way be considered as an admission that such related art is widely known or forms part of common general knowledge in the field.

Tube of substances have been in use for many years. In the past, it has often been difficult to extract a substance from such tubes, particularly in cases where the substance being dispensed therefrom is of high viscosity. Additionally, it is often difficult to dispense the last of a substance from a tube due to the nature of tubes. When the substance being stored therein is of high value, it can be a significant drawback to have to dispose of any portion thereof due to inability to dispense.

Because of the inherent problems with the related art, there is a need for a new and improved tube extraction device for squeezing a substance out of a tube.

BRIEF SUMMARY OF THE INVENTION

The invention generally relates to a tube dispenser which includes a base member and an upper plate hingedly secured to the base member. A lever including a handle portion and a cam portion is pivotally secured directly above the upper plate such that the cam portion rests thereon. An adjustment rod is positioned below the base member and includes an adjustably-secured constrictor. A knob at the end of the rod may be used to advance the constrictor forward along the rod. As the constrictor advances, it constricts the upper plate against the base member, thus dispensing the substance stored within any tube positioned between the upper plate and base member. If further pressure is needed, the lever may be pressed down to apply pressure from the cam portion directly onto the upper plate. A pressure knob may also be included for even more pressure capability.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
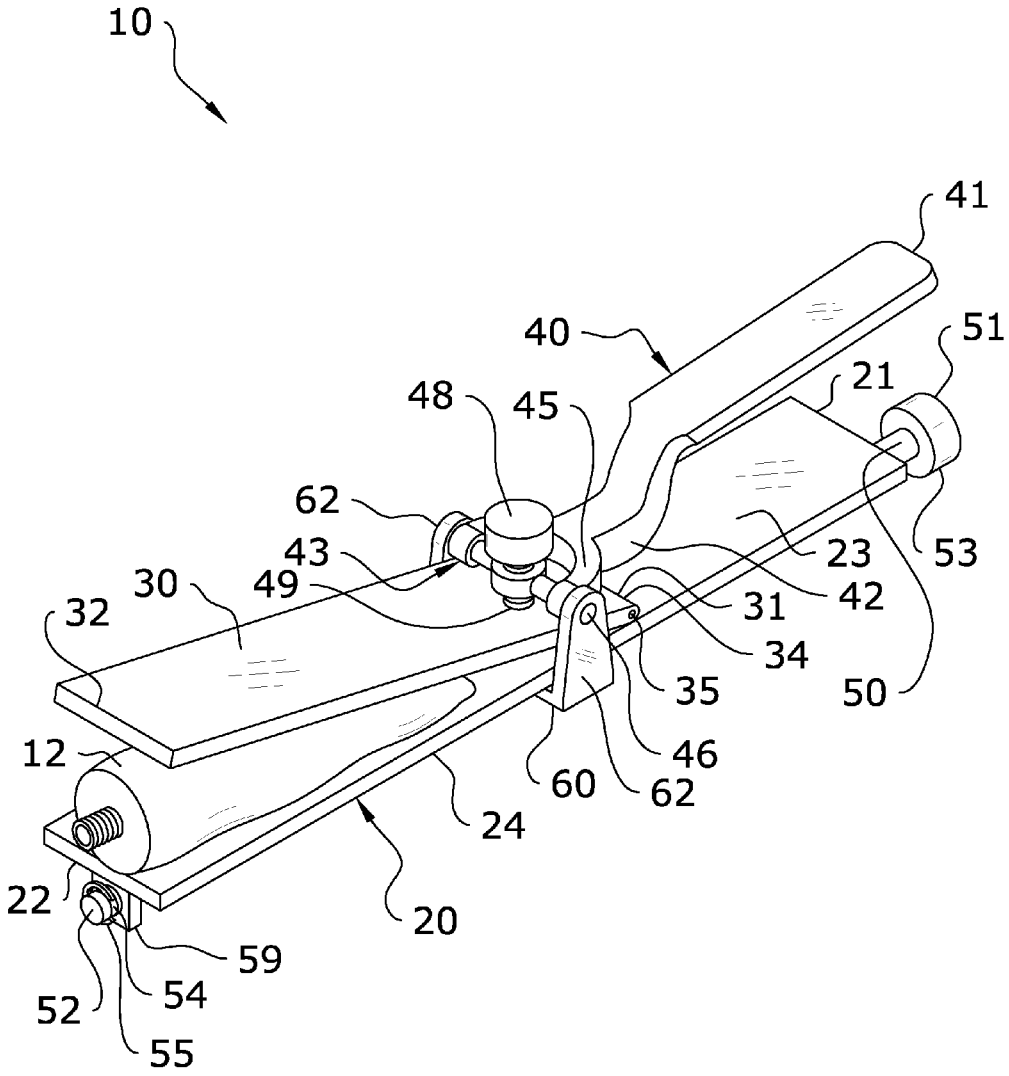
FIG. 1 is an upper perspective view of the present invention.

Turning now descriptively to the drawings, in which similar reference characters denote similar elements throughout the several views, FIGS. 1 through 9 illustrate a tube extraction device 10, which comprises a base member 20 and an upper plate 30 hingedly secured to the base member 20. A lever 40 including a handle portion 41 and a cam portion 42 is pivotally secured directly above the upper plate 30 such that the cam portion 42 rests thereon. An adjustment rod 50 is positioned below the base member 20 and includes an adjustably-secured constrictor 60. A knob 53 at the end 51 of the rod 50 may be used to advance the constrictor 60 forward along the rod 50. As the constrictor 60 advances, it constricts the upper plate 30 against the base member 20, thus dispensing the substance stored within any tube 12 positioned between the upper plate 30 and base member 20. If further pressure is needed, the lever 40 may be pressed down to apply pressure from the cam portion 42 directly onto the upper plate 30. A pressure knob 48 may also be included for even more pressure capability.

B. Base Member

Figure 2:
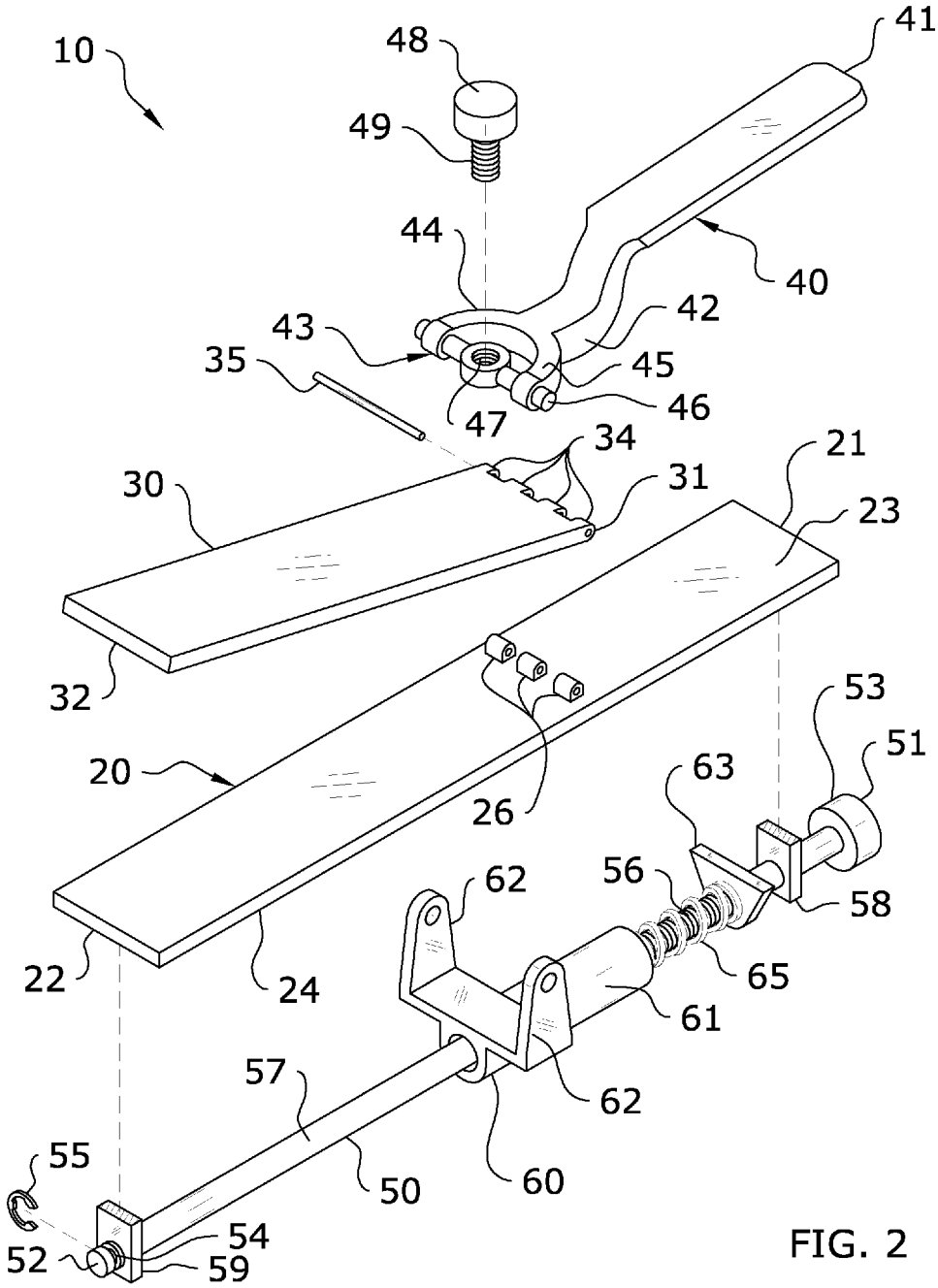
FIG. 2 is an exploded upper perspective view of the various components of the present invention.
Figure 3:
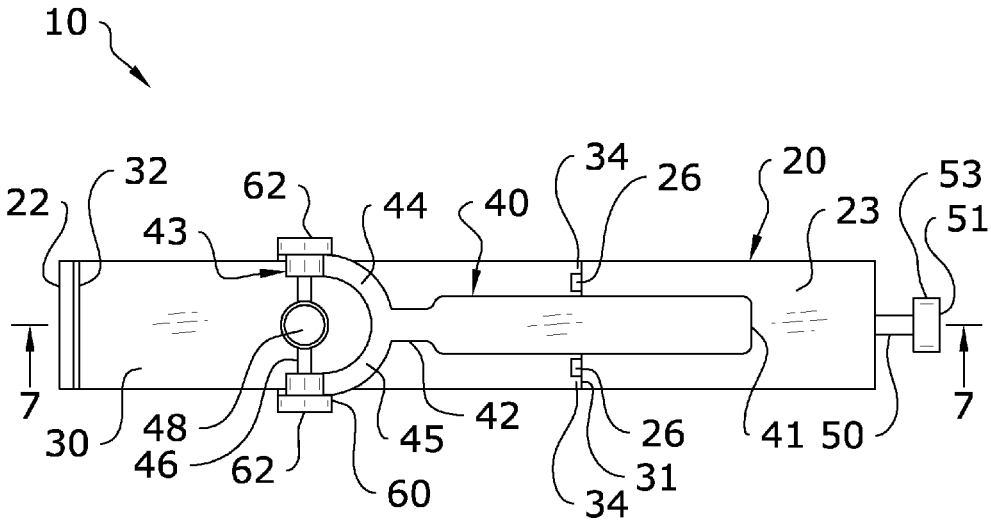
FIG. 3 is a top view of the present invention.
Figure 4:
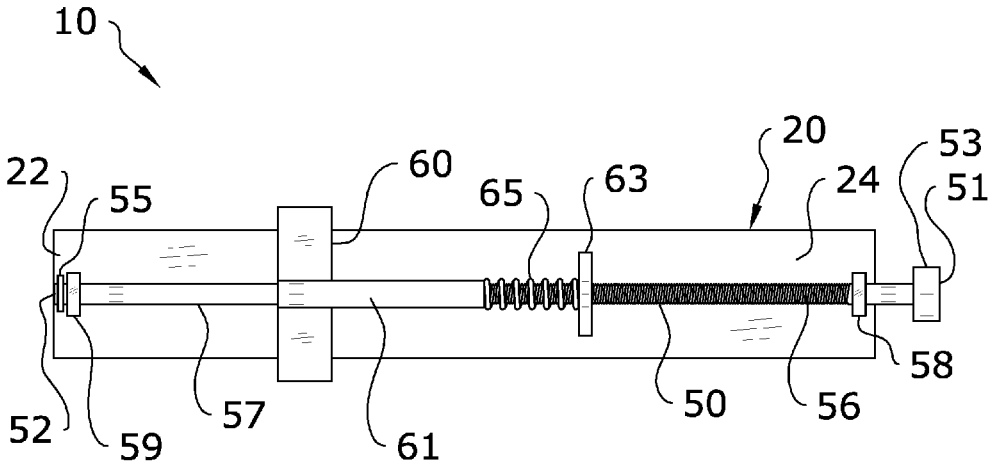
FIG. 4 is a bottom view of the present invention.

As shown in FIG. 2, the present invention includes a base member 20 against which a tube 12 of a substance will be squeeze and which links the various components of the present invention. The base member 20 is generally comprised of an elongated plate with a rectangular shape, though other configurations may be utilized. The base member 20 may be comprised of various rigid materials, such as plastics, metals, metal alloys and the like.

The base member 20 includes a first end 21 and a second end 22 as well as an upper end 23 and a lower end 24. The upper end 23 of the base member 20 includes one or more hinge receivers 26 which are adapted to act as a securing point to hingedly connect the upper plate 30 to the base member 20 as shown in FIG. 1. The structure and positioning of the hinge receiver(s) 26 may vary greatly in different embodiments so long as the upper plate 30 is hingedly secured to the upper end 23 of the base member 20.

C. Upper Plate

The present invention includes an upper plate 30 which is hingedly secured to the upper end 23 of the base member 20 as shown in FIG. 1. The upper plate 30, in combination with the base member 20, acts to squeeze the tube 12 and thus dispense any substance therein. The upper plate 30 may be activated to squeeze the tube 12 by advancing a constrictor 60, forcing down on a lever 40 to press a cam 42 against the upper plate 30, or tightening a pressure knob 48 which presses directly downward on the upper plate 30.

The upper plate 30 is generally comprised of an elongated plate which has a length less than that of the base member 20. The upper plate 30 may be rectangular as shown in the figures, or may be comprised of various other shapes. Preferably, the upper plate 30 will be of a similar width as the base member 20.

The upper plate 30 includes a first end 31 and a second end 32. The first end 31 of the upper plate 30 includes a plurality of hinge connectors 34 which align with the corresponding hinge receivers 26 of the base member 20. A first hinge pin 35 is secured within the hinge connectors 34 and hinge receivers 26 to hingedly secure the upper plate 30 to the base member 20. The second end 32 of the upper plate 30 is preferably positioned flush with the second end 22 of the base member 20 as shown in the figures.

D. Lever

The present invention includes a lever 40 which is utilized in conjunction with the constrictor 60 to squeeze the tube 12 to dispense its contents. The lever 40 is hingedly secured directly to the constrictor 60 adjacent the upper end 31 of the upper plate 30 as shown in FIG. 1. The lever 40 may be comprised of various shapes, widths and lengths depending on the embodiment of the present invention, and thus should not be construed as being limited by the exemplary figures. The effective height of the lever 40 may be adjusted with the knob 53 such that when utilized it may be oriented almost parallel with the upper plate 30 to be most effectively squeezed with one hand.

Figure 6:
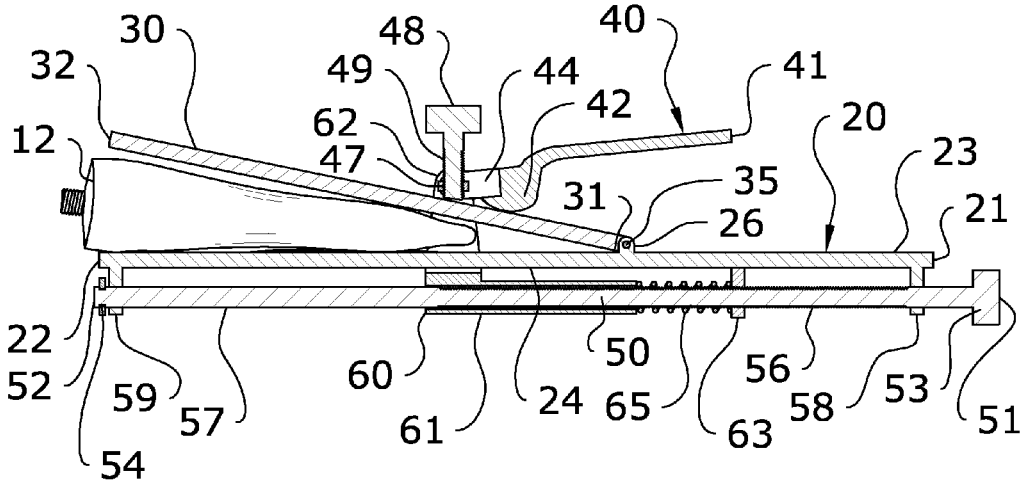
FIG. 6 is a side sectional view of the present invention with a tube positioned between its base plate and upper plate.
Figure 7:
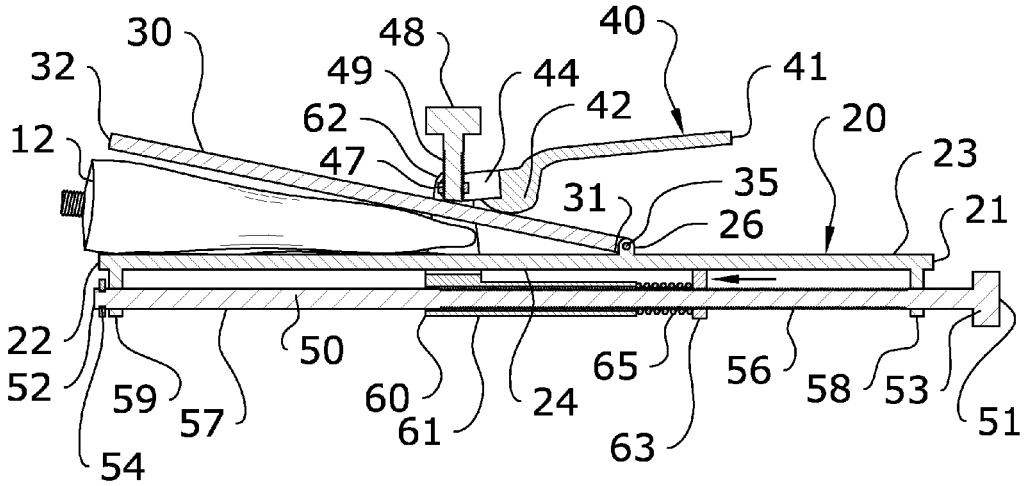
FIG. 7 is a side sectional view of the present invention illustrating advancement of the constrictor.
Figure 8:
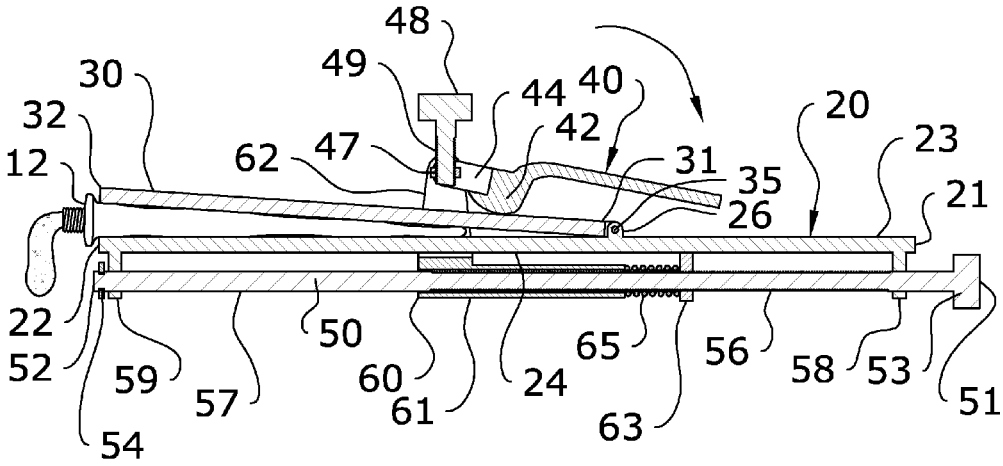
FIG. 8 is a side sectional view illustrating application of pressure from the cam on the upper plate to squeeze the tube.
Figure 9:
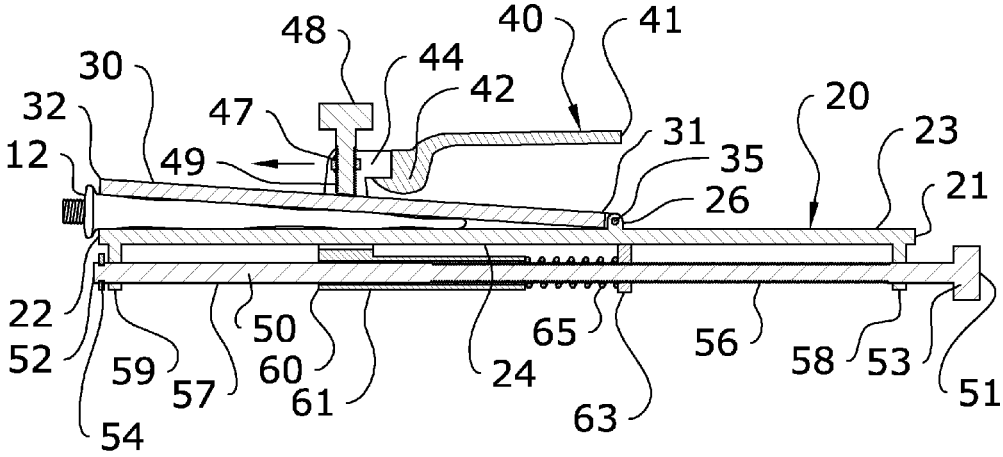
FIG. 9 is a side sectional view of the pressure knob being utilized to squeeze the upper plate against the tube.

As best shown in FIG. 2, the lever 40 comprises a handle portion 41, a cam portion 42 and a pivot assembly 43. The handle portion 41 comprises the portion of the lever 40 adjacent to its distal end and is adapted to be grasped by a user when the present invention is in use. The cam portion 42 is positioned at a proximate end of the lever 40 and includes a cam 42 adapted to press against and thus apply pressure to the upper plate 30 when the lever 40 is activated as best shown in FIGS. 6 and 7. The fulcrum of the cam 42 is ideally positioned relatively close to the pivot assembly 43 so as to cause tremendous pressure on the upper plate 30 when expressing particularly viscous materials.

A pivot assembly 43 is included on the lever 40 adjacent to the cam portion 42 as shown in FIGS. 1 and 2. The pivot assembly 43 pivotally secures the lever 40, and thus the cam 42, to the constrictor 60. The pivot assembly 43 may be comprised of various assemblies and devices known in the art to pivotally or hingedly secure one article to another.

In a preferred embodiment as shown in the figures, the pivot assembly 43 comprises a first arm 44 extending in an arced-manner in a first direction from the cam 42 and a second arm 45 extending in an arced-manner in a second direction from the cam 42. A connector member 46 is secured between the pair of arms 44, 45 such that the arms 44, 45 may freely rotate about the connector member 46.

The connector member 46 may include a threaded opening 47 located at a midpoint of its length as best shown in FIG. 2. The threaded opening 47 is adapted to threadably receive a pressure knob 48 via a threaded fastener 49 extending therefrom. By turning the pressure knob 48 and engaging the threaded fastener 49 with the threaded opening 47, the pressure knob 48 may be advanced downward to apply pressure to the upper plate 30 and thus squeeze the tube 12.

E. Adjustment Rod

The present invention utilizes an adjustment rod 50 to which the constrictor 60 of the present invention is slidably and adjustably secured. The adjustment rod 50 acts as a connection point of the constrictor 60 of the present invention. The adjustment rod 50 is comprised of an elongated member such as a rod which is rotatably secured beneath the base member 20 parallel to its lower end 24 by a pair of anchors 58, 59.

The adjustment rod 50 includes a first end 51 and a second end 52. The first end 51 of the adjustment rod 50 includes a knob 53 which, when turned, directly rotates the rod 50. A threaded portion 56 extends at least partially between the first end 51 and the second end 52 of the adjustment rod 50. A pusher member 63 is threadably secured to the threaded portion 56.

A bias member 65 such as a coil spring may be positioned over the threaded portion 56. The coil spring 65 is preferably not connected to the pusher 63 or constrictor 60 of the present invention. When the knob 53 is turned in a first direction, the pusher member 63 will advance across the threaded portion 56 and compress the spring 65 against the constrictor 60. This pushes the constrictor 60 along an unthreaded portion 57 of the adjustment rod 50 which extends a distance from the second end 52 in toward the first end 51 as shown in the figures.

Turning the knob 53 in a second direction will recede the pusher 63 back along the threaded portion 56 and thus release tension from the spring 65, causes it to stop applying pressure to the constrictor 60. The constrictor 60 may not automatically rescind along the unthreaded portion 57 absent such force, and may in some embodiments need to be manually reset to a rested position. The tube member 61 of the constrictor 60 is slidably secured about the unthreaded portion 57 so as to allow the constrictor 60 to freely slide along the unthreaded portion 57 of the rod 50.

Due to spring compression, repeated squeezes down on the lever 40 will cause the constrictor 60 to advance. Simply pushing distally on the lever 40 will also advance the constrictor 60 along the unthreaded portion 57. With less viscous materials, it is possible to slide the constrictor 60 distally and operate the cam 42 and lever 40 without use of the knob 53 for added pressure on the constrictor 60. Thus, the knob 53 is preferably utilized with more viscuous materials where additional force from the constrictor 60 is needed to reduce the amount of force necessary on the lever 40.

The present invention further includes a first anchor 58 which extends downwardly from the lower end 24 of the base member 20 adjacent to its first end 21. Similarly, a second anchor 59 extends downwardly from the lower end 24 of the base member 20 adjacent to its second end 22. The adjustment rod 50 is rotatably positioned within the openings in the respective anchors 58, 59.

An E-clip 55 positioned within a groove 54 may be utilized adjacent the second end 52 of the adjustment rod 50. The E-clip 55 snaps into the groove 54 in the adjustment rod 50 adjacent to the second anchor 59 so that the rod 50 may only rotate but not move forward or backwards. This E-clip 55 also provides the anchor such that the rod 50 will advance the pusher 63.

F. Constrictor

The present invention includes a constrictor 60 which is slidably secured to the unthreaded portion 57 of the adjustment rod 50 as shown in the figures. The constrictor 60 may be advanced along the adjustment rod 50 to squeeze the upper plate 30 against the base member 20 as the constrictor 60 is advanced along the adjustment rod 50 through turning of the knob 53, which forces the constrictor 60 forward through pressure from the pusher 63 and bias member 65.

Figure 5:
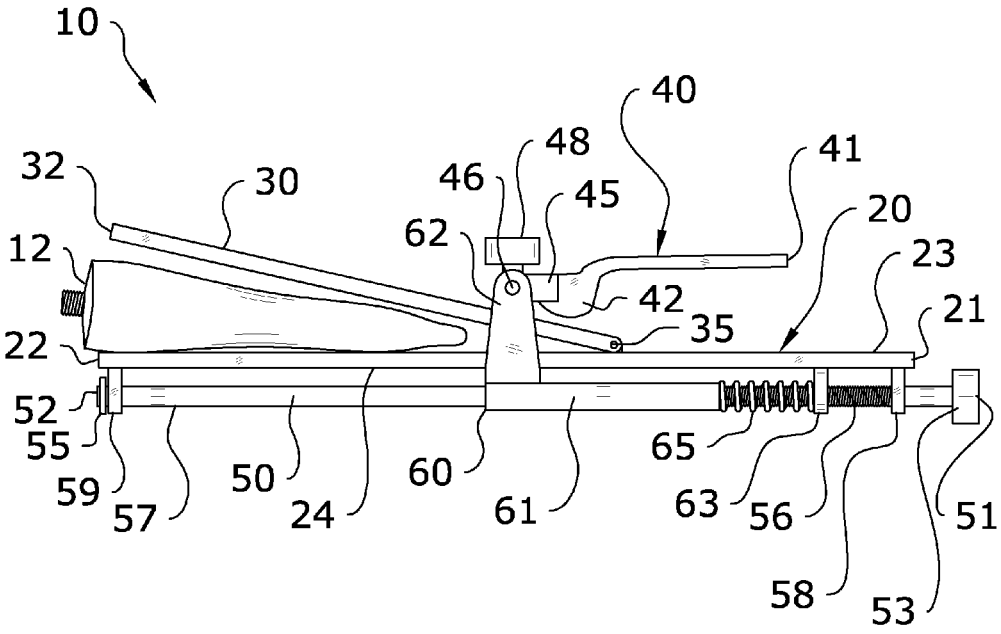
FIG. 5 is a side view of the present invention.

The constrictor 60 is generally comprised of a tube member 61 and a bracket 62 extending upwardly therefrom as shown in FIG. 5. The tube member 61 is comprised of a tube which is unthreaded on its interior so that it may freely slide along the adjustment rod 50 when pressure is applied by the spring 65 or through use of the lever 40. The tube member 61 is fixedly secured to or integrally formed with the bracket of the constrictor 60, which extends upwardly from the tube member 61 as best shown in FIG. 2.

A pusher 63 attached to the knob 53 and threadably secured around the threaded portion 56 of the adjustment rod 50 will push the spring 65 against the constrictor 60, causing it to advance across the unthreaded portion 57 of the adjustment rod 50 as the adjustment rod 50 is rotated by the knob 53. The pusher 63 makes contact with the lower end 24 of the base 20 so that it will not rotate, but only slide when advanced with the knob 53. The pusher 63 will thus preferably include a flat upper end as best shown in FIG. 2 to catch on the lower end 24 and prevent such rotation, though other configurations may be utilized.

The bracket 62 is utilized to secure the lever 40 to the constrictor 60 and extends upwardly from the tube member 61 thereof. The connector member 46 of the lever 40 is positioned within the bracket 62 to hingedly secure the lever 40 to the constrictor 60. As the constrictor 60 advances along the adjustment rod 50, the cam 42 of the lever 40 will cause more and more pressure on the tube 12 positioned between the base member 20 and upper plate 30, thus squeezing out its contents.

G. Operation of Preferred Embodiment

In use, a tube 12 of a substance is first positioned between the base member 20 and the upper plate 30. To dispense the substance within the tube 12, the lever 40 may be pressed down using its handle 41. This will force the cam 42 against the upper plate 30, thus providing a significant amount of additional force pressing the upper plate 30 against the base plate 20 to squeeze the tube 12.

If additional force is needed, the knob 53 may be turned, which rotates the adjustment rod 50, thus causing the pusher 63 to advance along the threaded portion 56 and push against the bias member 65. The bias member 65 forces the constrictor 60 to advance across the unthreaded portion 57 of the rod 50. As the constrictor 60 advances, the upper plate 30 is pressed against the lower plate 20, thus squeezing the tube 12 positioned therebetween. The lever 40 may then be activated for even more pressure on the tube 12. If further force is needed, the pressure knob 48 may be turned to press directly downward on the upper plate 30.

When completed with dispensing, the knob 53 may be turned in the opposite direction which will allow the constrictor 60 to retract along the unthreaded portion 57 of the rod 50 to a resting position by simply sliding along the unthreaded portion 57. The present invention is thus free for repeated use on additional tubes 12 of material.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A tube extraction device, comprising:

a base member;

an upper plate hingedly secured to said base member;

an adjustment rod secured beneath said base member;

a constrictor adjustably slidably secured to said adjustment rod, wherein said constrictor includes a bracket; and a lever positioned above said upper plate, said lever being hingedly secured to said bracket, wherein said lever includes a handle portion and a pivot assembly, wherein said pivot assembly is secured to said bracket, wherein said pivot assembly comprises a first arm, a second arm and a connector member rotatably secured therebetween, wherein said connector member is secured to said bracket, wherein said connector member includes a threaded opening.

2. The tube extraction device of claim 1, wherein said lever includes the handle portion and a cam portion.

3. The tube extraction device of claim 2, wherein said cam portion is adapted to apply pressure directly to said upper plate when force is applied to said handle portion of said lever.

4. The tube extraction device of claim 1, further comprising a pressure knob threaded secured within said threaded opening, said pressure knob being adapted to apply pressure directly to said upper plate when threadably advanced within said threaded opening.

5. The tube extraction device of claim 1, wherein said adjustment rod includes a threaded portion and an unthreaded portion.

6. The tube extraction device of claim 5, further comprising a bias member surrounding said threaded portion of said adjustment rod.

7. A tube extraction device, comprising:

a base member;

an upper plate hingedly secured to said base member;

an adjustment rod positioned beneath said base member by a bracket;

a constrictor adjustably secured to said adjustment rod, wherein said bracket extends from said constrictor;

a knob connected to said adjustment rod, wherein said constrictor is adapted to advance forward along said adjustment rod upon turning of said knob in a first direction;

a lever comprising a handle portion, a cam portion, a first arm extending from said cam portion and a second arm extending from said cam portion; and a connector member extending between said first arm and said second arm, said lever being rotatably secured to said connecting member.

8. The tube extraction device of claim 7, wherein said cam portion is adapted to apply pressure directly to said upper plate when force is applied to said handle portion of said lever.

9. The tube extraction device of claim 7, wherein said connector member includes a threaded opening.

10. The tube extraction device of claim 8, further comprising a pressure knob threaded secured within said threaded opening, said pressure knob being adapted to apply pressure directly to said upper plate when threadably advanced within said threaded opening.

11. The tube extraction device of claim 7, wherein said adjustment rod includes a threaded portion and an unthreaded portion.

12. The tube extraction device of claim 11, further comprising a bias member surrounding said threaded portion of said adjustment rod.

13. The tube extraction device of claim 7, wherein said base plate includes one or more hinge receivers and wherein said upper plate includes one or more hinge connectors.

14. The tube extraction device of claim 7, further comprising a first anchor positioned adjacent to said knob and a second anchor positioned adjacent a second end of said adjustment rod.

15. The tube extraction device of claim 7, further comprising a pusher adapted to apply pressure to said constrictor upon activation of said knob.

16. A tube extraction device, comprising:

a base member;

an upper plate hingedly secured to said base member;

an adjustment rod positioned beneath said base member by a bracket, wherein said adjustment rod includes a threaded portion and an unthreaded portion, further comprising a bias member surrounding said threaded portion of said adjustment rod;

a constrictor adjustably secured to said adjustment rod, wherein said bracket extends from said constrictor;

a knob connected to said adjustment rod, wherein said constrictor is adapted to advance forward along said adjustment rod upon turning of said knob in a first direction;

a pusher adapted to apply pressure to said constrictor upon activation of said knob;

a lever comprising a handle portion, a cam portion, a first arm extending from said cam portion and a second arm extending from said cam portion;

a connector member extending between said first arm and said second arm, said lever being rotatably secured to said connecting member, wherein said connector member includes a threaded opening; and a pressure knob threaded secured within said threaded opening, said pressure knob being adapted to apply pressure directly to said upper plate when threadably advanced within said threaded opening.

* * * * *